United States Patent [19]

Harper

[11] Patent Number: 4,828,321

[45] Date of Patent: May 9, 1989

[54] PORTABLE BEACH LOUNGE

[76] Inventor: Michael Harper, 2207 Missouri Ave., Granite City, Ill. 62040

[21] Appl. No.: 157,293

[22] Filed: Feb. 18, 1988

[51] Int. Cl.[4] ..... A47C 1/10

[52] U.S. Cl. ..... 297/391; 5/434; 297/188

[58] Field of Search ..... 248/447.2; 297/391, 297/188; 5/434; 135/16

[56] References Cited

U.S. PATENT DOCUMENTS

| | | | |
|---|---|---|---|
| 1,821,060 | 9/1931 | Isaacson | 348/447.2 |
| 1,982,097 | 11/1934 | Harris | 135/16 |
| 2,070,484 | 2/1937 | Jones | 297/391 |
| 3,241,160 | 3/1966 | Escobar | 297/184 X |
| 3,574,590 | 11/1951 | Ross | 297/391 X |
| 4,544,203 | 10/1985 | Younger et al. | 297/391 |
| 4,560,128 | 12/1985 | Willeby et al. | 297/188 X |

FOREIGN PATENT DOCUMENTS

| | | | |
|---|---|---|---|
| 2393551 | 2/1979 | France | 5/434 |
| 1543887 | 4/1979 | United Kingdom | 5/434 |

*Primary Examiner*—James T. McCall
*Attorney, Agent, or Firm*—Don W. Weber

[57] ABSTRACT

A portable beach headrest is presented having a double u-shaped frame, said frame members being hingedly and collapsibly connected to each other by upper and lower locking hinges. A flexible headrest is secured in between the vertical legs of the frame and a collapsible umbrella is detachably secured to one front vertical leg. To the other front vertical leg is secured either a beverage platform or an adjustable book tray. Friction bumpers are secured to the bottom of the frame to adapt the portable beach lounge for use on non-natural surfaces.

7 Claims, 2 Drawing Sheets

PORTABLE BEACH LOUNGE

BACKGROUND OF THE INVENTION

This invention relates to the field of outdoor recreational devices and is particularly suited for use on a beach or at a lake or swimming pool. The device is used to support the user's head when in a reclining position. The lounge also includes a small umbrella to provide shade and a beverage or book support. Rubber traction feet are also provided to prevent sliding on concrete or other non-natural surfaces.

Conventionally, recreational headrests comprise an inflatible rubber cushion or towel placed under the head. Other devices are known in the art such as the one described in U.S. Pat. No. 4,641,883 by Kato. The Kato patent provides a headrest and sunshade, but does not include the other conveniences herein and is encumbered by a bulky substructure to support the actual headrest. One problem encountered in known devices is that this substructure of the device often falls directly under the head and neck area and the necessary natural flexibility of the headrest causes the neck and head to come to rest on the hard metal frame and braces. The instant invention solves the problems left open by the Kato and other devices.

An object of this invention is to provide a lightweight, portable combination headrest, beverage rest, and sunshade. Because of the particular new structure as described herein, the device enables a sunbather to rest his or her head, receive shade from the sun, and read (or drink a beverage) all in a reclining position.

Another object of this invention is to provide a non-slipping portable beach headrest capable of use on non-natural surfaces.

Other objects of the invention will become obvious after reviewing the following specification and the drawings.

DETAILED DESCRIPTION OF THE PREFERRED EMBODIMENT

Figure 1:
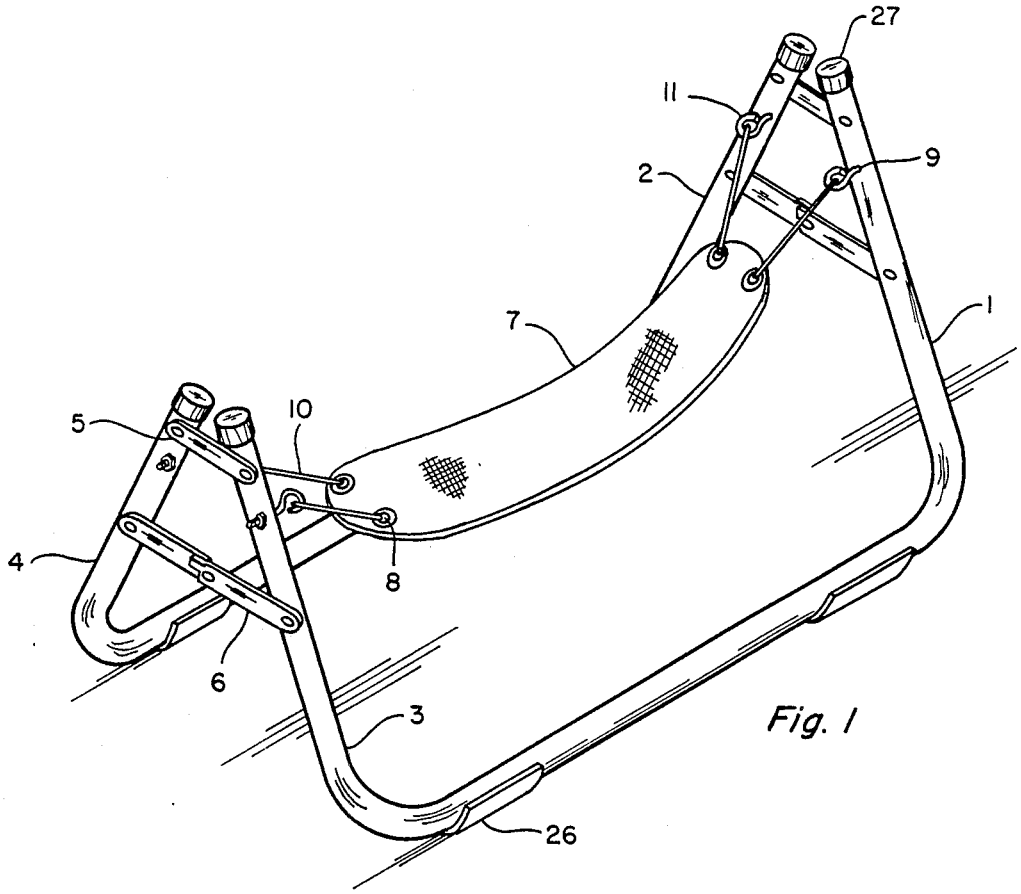
FIG. 1 shows a perspective view of the beach lounge without the beverage container support attached.

The main frame of the beach lounge comprises two U-shaped front (1) and back (2) members made of extremely lightweight tubular aluminum or other similarly strong but light material. The two U-shaped members are collapsibly connected to each other by two pairs of hinges. It has been found that $\frac{3}{4}$ inch or $\frac{1}{2}$ inch stock aluminum tubing is preferred for the frame. One verticle leg of the front U-shaped member (3) is connected to a corresponding vertical leg of the back U-shaped member (4) by an upper locking hinge (5) and a lower locking hinge (6) as shown on FIG. 1. The locking hinges are pivotably attached to each leg by means of rivets or bolts. The remaining vertical leg of the front and back U-shaped members are similarly connected by upper and lower locking hinges on the opposite end of the frame. The locking hinges are a type commonly in use. The hinges lock open in a fully extended position, but may be hingedly closed so as to allow the front and back U-shaped members to fold together for ease of transportation and storage. Alternatively, the two u-shaped members may be permanently connected in an open position by means of permanently fixed braces rivetted to the members in place of the hinges. The ends of the U-shaped members have plastic caps (27) thereon to keep rain or other elements out of the tubes.

Figure 7:
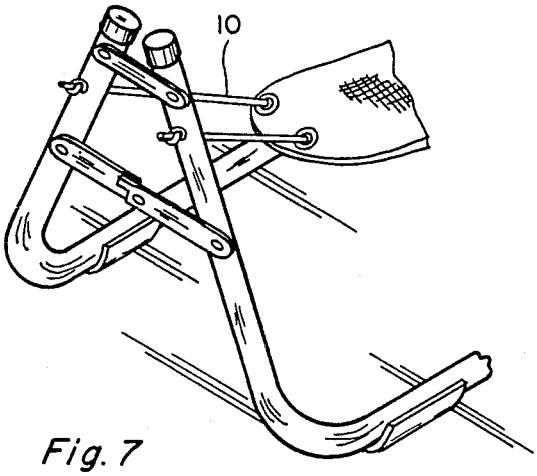
FIG. 7 is a detailed view showing the method in which the headrest ropes may be attached to the frame by knotting.

Attached to the frame is a flexible headrest (7). The headrest is made of a nylon or canvas material of sufficient strength to support the head of the user. Other suitable materials may be used for the headrest such as parachute-type material or vinyl plastic. The strength and weight of the material is crucial, however, and strong, lightweight nylon is most suitable. The headrest has a pair of small eyelets (8) at each edge. Nylon rope (10) is passed through these eyelets and looped through frame eyelet bolts (11) and secured, as shown, in the frame eyelet holes (9). See FIG. 1. Alternate methods of attaching the headrest to the frame are available. For example, the support ropes (10) can be inserted through a hole in the frame and knotted, thus securing the ropes to the frame. This method of securing the ropes to the frame is shown in FIG. 7. Cables or other suitable, flexible attaching means may be used. The headrest swings on its support ropes to accommodate different angles of repose of the user.

Figure 2:
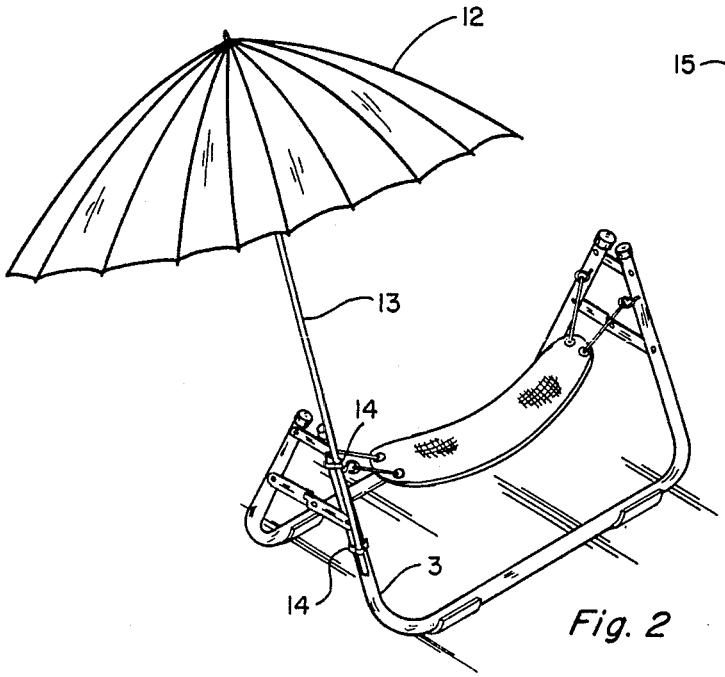
FIG. 2 is a perspective view of the beach lounge showing the umbrella and umbrella shaft attaching clamps.
Figure 3:
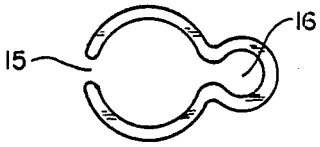
FIG. 3 is a detail cross-sectional view of the resilient plastic snaps.

Also attached to the frame is a collapsible sunshade umbrella (12), shown in FIG. 2. The umbrella is collapsible and is in common use in the field of sun-screens and beach use. The shaft of the umbrella (13) is detachably secured to a first front vertical leg (3) by means of flexible resilient plastic snaps (14). The snaps comprise flexible circular rings which encase the vertical leg (3) and umbrella shaft (13). The rings have a slot 915) in a small section of the circumference and a semi-circular bulge (16) to accomodate the umbrella shaft (13) as best shown in FIG. 3. The snaps are flexible yet have elastic memory and enable the user to detachably secure the umbrella to any vertical leg of the device as shown in FIG. 2. The snaps may be replaced by C-clamps or worm-gear clamps, and may be either plastic or resilient metal. The umbrella shaft may alternatively be permanently secured to the leg by bolts or rivets.

Figure 4:
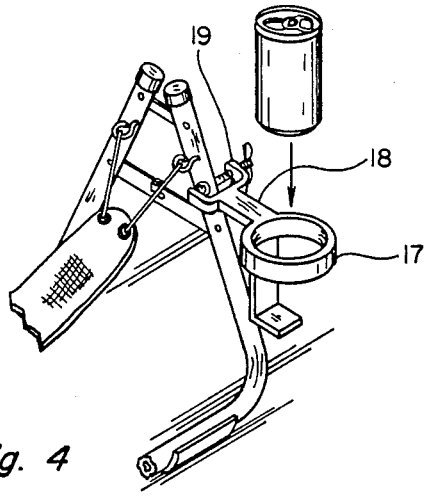
FIG. 4 is a perspective view of the right side of the device showing an alternate embodiment having a beverage container support attached thereto.

On an opposite, second front vertical leg is secured a beverage holder, as shown in FIG. 4. This beverage holder comprises a beverage platform (17) and a beverage arm support (18). The end of the support is detachably secured to the vertical leg by means of a C-clamp (19). By loosening the C-clamp, the beverage holder may be removed for ease of storage. Alternatively, the beverage holder may be permanently secured to the vertical arm by welding a securing plate to the end of the beverage platform support arm and rivetting said plate to the vertical arm of the frame member.

Figure 5:
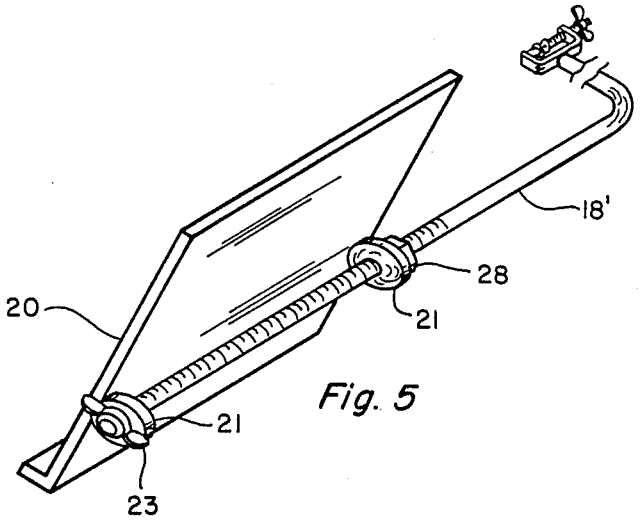
FIG. 5 is a detail perspective view showing the book support and arm.

In place of the beverage holder, one may secure an adjustable book tray for reading. The book tray arm (18), shown in FIG. 5, is attached to the vertical arm of the frame member in a similar fashion as the beverage support. The book support arm (18') extends to hold the book tray (20) in front of the beach lounge user. The book tray is L-shaped and has a pair of book tray brackets (21), one located on each end of the book tray. The book tray arm (18') extends through the book tray support rackets. The end of the book tray support arm is threaded. The book tray support arm has a stop (28) placed as shown in FIG. 5. A wing-nut (23) is fastened to the end of the book tray support arm and secures the book tray (20) to the arm (18') at any suitable angle for reading. The book tray support arm is preferably steel rod of suitable strength. The actual book tray is made of lightweight metal or plastic.

Figure 6:
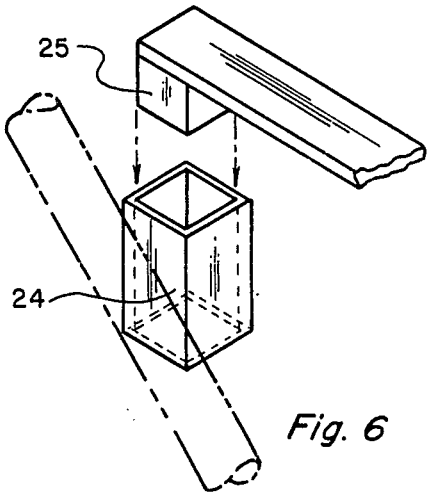
FIG. 6 is a detail view showing one method of easily detaching a book or beverage support.

It is possible to attach both the beverage platform and book support tray to the vertical leg of the frame members, but in practice it has been found that both conveniences are somewhat cumbersome when used simultaneously. Another embodiment of this invention includes a utility bracket (24) permanently attached to the right vertical leg. The book or beverage support arm is then fashioned so that the end thereof (25) fits into the utility bracket (24). The beverage platform and book tray are then interchangeable at the pleasure of the user. See FIG. 6.

To adapt the beach lounge for use on artificial or slippery surfaces, friction bumpers (26) are secured to the bottom of the U-shaped frames as shown in FIG. 1. These bumpers may be glued or secured by bolts. The bumpers are normally made of rubber or a similar high friction material. These bumpers prevent the lounge from sliding when it is placed on concrete or another non-natural surface. In normal use, the bottom of the frame members are embedded in the sand on the beach and do not slide. Obviously, the umbrella and book or beverage supports can be placed on the opposite vertical leg to accomodate local conditions and position of the user and user and the sum.

As shown and described, the portable beach lounge discloses a lightweight, portable headrest that also includes a collapsible umbrella, and either a beverage support or book tray. Because of the unique sub-structure, the support for the headrest does not impinge on the comforttable use of the device.

The specific description here is meant as a means of illustration only and not as a limitation. Other equivalent means of securing the various parts and minor variations are in keeping with the spirit of this invention.

Having disclosed my invention above, I claim:

1. A portable beach headrest and lounge, comprising:
(a) two lightweight integrally constructed front and back U-shaped frame members collapsibly connected to each other by two pairs of locking hinges, wherein each frame member has two vertical legs and each leg has a rope-receiving hole near the top thereof, further comprising a plurality of friction bumpers secured to the bottom of said frame members;
(b) a flaccid flexible headrest swingably attached to each of said vertical legs by inserting nylon ropes through said rope-receiving holes and knotting said ropes;
(c) a small collapsible umbrella detachably secured to a first front vertical leg of same frame; wherein said detachable securing means comprises a plurality of flexible resilient double-circular snaps; and
(d) an adjustable, L-shaped book tray detachably secured to a second front vertical leg of said frame by means of a C-clamp, wherein the angle of presentment of said book tray may be simply adjusted by a wing-nut at the end of a book tray support arm.

2. A portable beach headrest and lounge as in claim 1, wherein said adjustable, L-shaped book tray is permanently attached to a second front vertical leg of said frame.

3. A portable beach headrest and lounge, comprising:
(a) two lightweight integrally constructed front and back U-shaped frame members collapsible connected to each other by two pairs of locking hinges, wherein each frame member has two vertical legs and each leg has a rope-receiving hole near the top thereof further comprising a plurality of friction bumpers secured to the bottom of said frame members;
(b) a flaccid flexible headrest swingably attached to each of said vertical legs by inserting nylon ropes through said rope-receiving holes and knotting said ropes;
(c) a small collapsible umbrella detachably secured to a first front vertical leg of said frame; wherein said detachable securing means comprises a plurality of flexible resilient double-circular snaps; and
(d) a beverage container support detachably secured to a second front leg of said frame, wherein said beverage support comprises a beverage platform and a beverage arm support, said arm support having a C-clamp at the end thereof for securing said container support to said second front leg.

4. A portable beach headrest and lounge comprising:
(a) two lightweight integrally constructed front and back U-shaped frame members collapsibly connected to each other by two pairs of locking hinges, wherein each frame member has two vertical legs and each leg has a rope-receiving hole near the top thereof further comprising a plurality of friction bumpers secured to the bottom of said frame members;
(b) a flaccid flexible headrest swingably attached to each of said vertical legs by inserting nylon ropes through said rope-receiving holes and knotting said ropes;
(c) a small collapsible umbrella detachably secured to a first front vertical leg of same frame, wherein said detachable securing means comprises a plurality of flexible resilient double-circular snaps; and
(d) a utility bracket permanently attached to the second front leg of said frame;
(e) a book support and a beverage platform each having a securing end fashioned so that said book support or said beverage platform may be interchangeably attached to said utility bracket;
whereby said portable beach lounge may alternatively hold a beverage or a book for the user thereof.

5. A portable beach headrest and lounge as in claim 1, further comprising four eyelet bolts which are secured through frame eyelet holes, wherein said flaccid, flexible headrest is swingably attached to said legs by means of attaching ropes secured between said eyelet bolts and said headrest.

6. A portable beach headrest and lounge as in claim 3, further comprising four eyelet bolts which are secured through frame eyelet holes, wherein said flaccid, flexible headrest is swingably attached to said legs by means of attaching ropes secured between said eyelet bolts and said headrest.

7. A portable beach headrest and lounge as in claim 4, further comprising four eyelet bolts which are secured through frame eyelet holes, wherein said flaccid, flexible headrest is swingably attached to said legs by means of attaching ropes secured between said eyelet bolts and said headrest.

* * * * *